United States Patent [19]

Preuss et al.

[11] 4,444,067

[45] Apr. 24, 1984

[54] POWER DRIVE INCLUDING A DRIVE SLIDE FOR ELECTRIC SWITCHGEAR

[75] Inventors: Bernhard Preuss; Reinhard Zeuke, both of Berlin, Fed. Rep. of Germany

[73] Assignee: Siemens Aktiengesellschaft, Munich, Fed. Rep. of Germany

[21] Appl. No.: 253,585

[22] Filed: Apr. 13, 1981

[30] Foreign Application Priority Data

Apr. 15, 1980 [DE] Fed. Rep. of Germany ..... 3014824

[51] Int. Cl.[3] ..... H01H 71/70

[52] U.S. Cl. ..... 74/108; 335/76; 335/68

[58] Field of Search ..... 74/101, 102, 103, 104, 74/108, 50, 49; 200/330; 335/76, 68, 189

[56] References Cited

U.S. PATENT DOCUMENTS

| | | | |
|---|---|---|---|
| 2,237,530 | 4/1941 | Olleg | 74/50 UX |
| 2,627,562 | 2/1953 | Cataldo | 74/50 |
| 3,171,920 | 3/1965 | Klein et al. | 200/92 |
| 3,213,235 | 10/1965 | Soos, Jr. | 200/92 |
| 3,286,211 | 11/1966 | Soos | 335/68 |
| 3,328,731 | 6/1967 | Huska | 335/74 |
| 3,371,296 | 2/1968 | Salvati et al. | 335/74 |
| 3,590,648 | 7/1971 | Gorman | 74/103 |
| 3,651,700 | 3/1972 | Bailey | 74/107 |
| 3,752,947 | 8/1973 | Strobel | 200/172 A |
| 3,816,686 | 6/1974 | Budd et al. | 200/330 |

FOREIGN PATENT DOCUMENTS 902317 8/1962 United Kingdom .

*Primary Examiner*—William F. Pate, III

*Attorney, Agent, or Firm*—Kenyon & Kenyon

[57] ABSTRACT

Disclosed is a power drive for electric switchgear, for example, protective low-voltage breakers. The power drive comprises a support plate and a drive slide which is guided between the support plate and the top or front side of the switchgear. The drive slide includes side walls into which a projection located on the top side of the switchgear extends for guiding the drive slide on the switchgear. The drive slide cooperates with the switchgear actuating handle through an opening having curved surfaces. The power drive includes a U-shaped leaf-spring which extends transversely to the direction of motion of the drive slide and which provides for elastic transmission of force from a crank coupled to a gear box to the actuating handle of the switchgear.

15 Claims, 3 Drawing Figures

POWER DRIVE INCLUDING A DRIVE SLIDE FOR ELECTRIC SWITCHGEAR

CROSS-REFERENCE TO RELATED APPLICATION

Some of the subject matter disclosed herein is common to subject matter disclosed in application Ser. No. 253,587 filed Apr. 13, 1981 entitled POWER DRIVE FOR ELECTRIC SWITCHGEAR IN WHICH DRIVING POWER IS ELASTICALLY TRANSMITTED application Ser. No. 253,586 filed Apr. 13, 1981 entitled MOTOR DRIVE FOR LOW-VOLTAGE PROTECTIVE CIRCUIT and application Ser. No. 253,584 filed Apr. 13, 1981 entitled "ROTARY HANDLE FOR MANUAL OPERATION OF AN EQUIPMENT POWER DRIVE". This application and the above-mentioned applications are owned by the same assignee.

BACKGROUND OF THE INVENTION

The present invention relates to a power drive for electric switchgear, especially protective low-voltage circuit breakers. The power drive is of the general type including a support plate for the drive parts as well as a drive slide extending over an actuating member of the switchgear which projects through a window-like opening of the power drive.

A power drive of the above type is disclosed, for example, in U.S. Pat. No. 3,328,731. The drive slide of the power drive described in the '731 patent is guided on the support plate. The correct alignment of the slide and its window-like opening relative to the actuating member of the switch depends on an accurate positioning and connection of the support plate to the switchgear. However, unavoidable tolerances can lead to a situation in which the drive slide does not axially cooperate with the actuating member, or does not cooperate at all with the actuating member in an area of the opening. As a result, it is possible that the driving forces are not uniformly applied to the actuating member, but can be locally concentrated in an undesirable manner. Premature wear of the cooperating parts or even breaking of the actuating member can occur as a consequence.

OBJECT AND SUMMARY OF THE INVENTION

It is an object of the present invention to provide a power drive of the above-described type in which the drive slide and the actuating member of the switchgear cooperate without wear, regardless of the manner of fastening of the support plate to the switchgear.

This and other objects are achieved in accordance with the invention by arranging the drive slide between the support plate and the side of the switchgear having the actuating member, with the drive slide being guided therebetween. Means can also be provided to guide the drive slide relative to the switchgear. The invention thereby provides automatic alignment of the power drive with the switchgear as well as with the switchgear actuating member.

According to one aspect of the invention, the material for making the drive slide, or selected parts thereof, can be made of a low friction material, such as plastic.

According to another aspect of the invention, the opening through which the actuating member of the switchgear, which can be a handle pivoted about a fulcrum, projects can be defined by curved surfaces.

Advantages of the invention, as compared with drive slides fabricated of stamped sheet metal parts, are less friction at the guide surfaces as well as automated production of a drive slide which can have a relatively complicated shape in order to provide for further functions.

According to another aspect of the invention, in addition to the guidance of the drive slide between the switchgear and the support plate, lateral guidance can be provided by a projection extending from the surface of the switchgear from which the actuating member extends and side walls extending from the drive slide about the projection. A projection is typically provided in the switching equipment of the type generally called "compact breakers." The distance between the side walls of the drive slide can be selected to correspond to the width of such a projection, thereby providing the lateral guidance.

According to the invention, a power drive can be accomplished by positioning the drive slide on the switchgear in such a manner that the actuating member protrudes through the window-like opening and then placing the support plate with the other parts of the drive on the switchgear. However, if it is desired to attach the support plate together with the parts of the drive including the drive slide on the switchgear, then the drive slide can be provided with an elongated opening or slot extending in the direction of motion of the drive and at least one holding member can be attached to the support plate to extend through the slot. The holding member prevents separation of the drive slide from the support plate. The holding member need not provide guidance for the drive slide after it is attached to the switchgear, and accordingly, an appropriate clearance can be provided between the elongated slot and the holding member.

Securement of the drive slide to the support plate up to the time that the drive is installed with the switchgear can be improved by providing a control slide which engages the drive slide. The drive slide can include a connecting piece on the side opposite to the elongated slot and the control slide can include an arm engaged by the connecting piece, the control slide being guided on the support plate to move parallel to the direction of motion of the drive slide. A generous clearance is provided between the connecting piece and the arm so that alignment of the drive slide relative to the actuating member of the switchgear is not affected.

According to the invention, a close tolerance may only be provided between the actuating member and the opening to prevent wear in the drive slide and the surface of the opening can be made of a low friction and/or wear-resistant material. Other tolerances may be made larger while not interfering with the cooperation between the actuating member and the opening.

The power drive advantageously includes a motor and the control slide is operative to switch off the motor of the power drive when the desired switch positions of the switchgear are reached. Advantageously, means are provided to frictionally resist motion of the control slide, for example, a drag slide can be provided. The control slide can also be provided with ribs for securing the drive slide to the support plate. The control slide can be provided with a control cam which cooperates with an end switch to switch the motor. Advantageously, the end switch can be a toggle switch. The control slide can include markings thereon to indicate the "on" position and the "off" position of the switchgear.

These objects and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
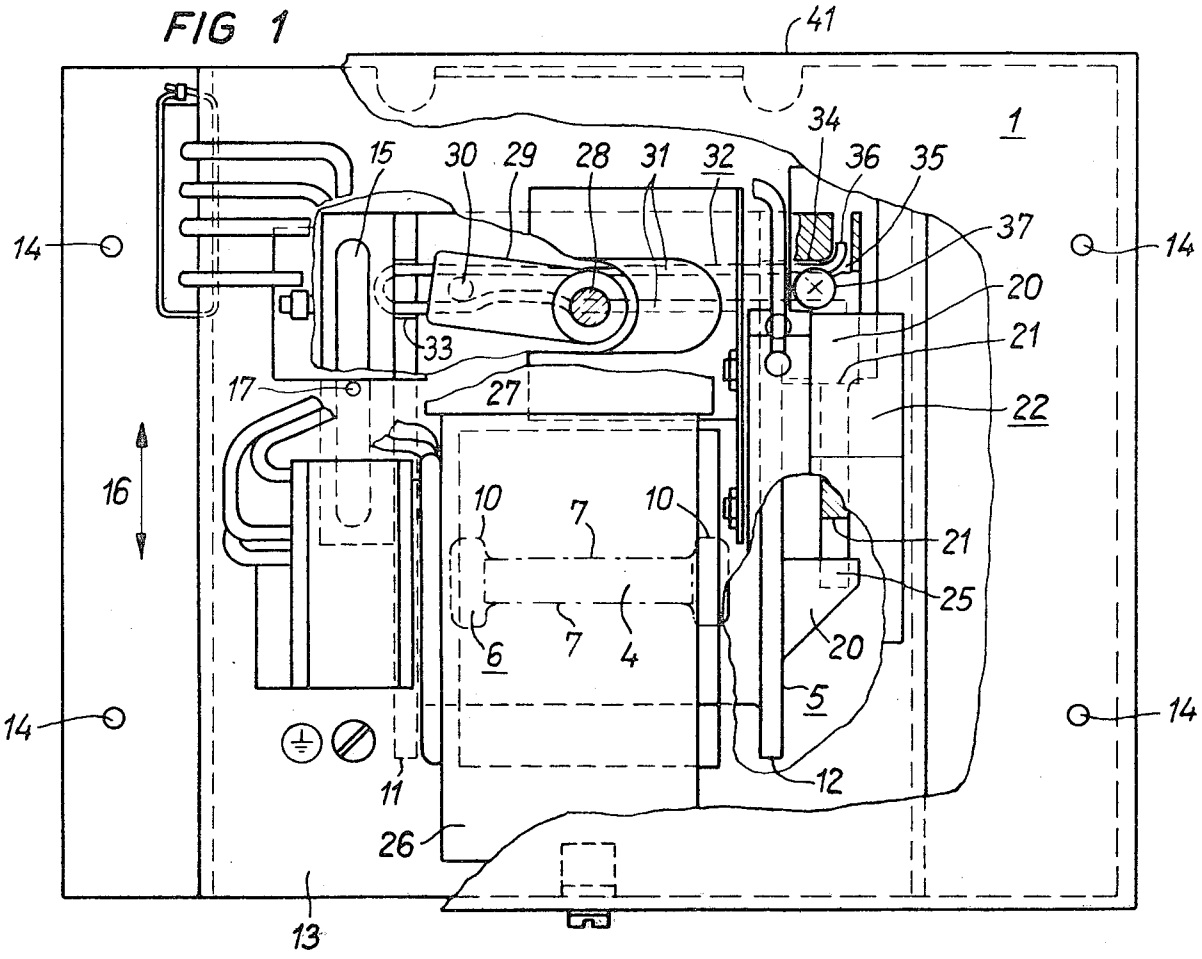
FIG. 1 is a top view, broken away in parts, of an electric switchgear power drive according to an embodiment of the invention.
Figure 2:
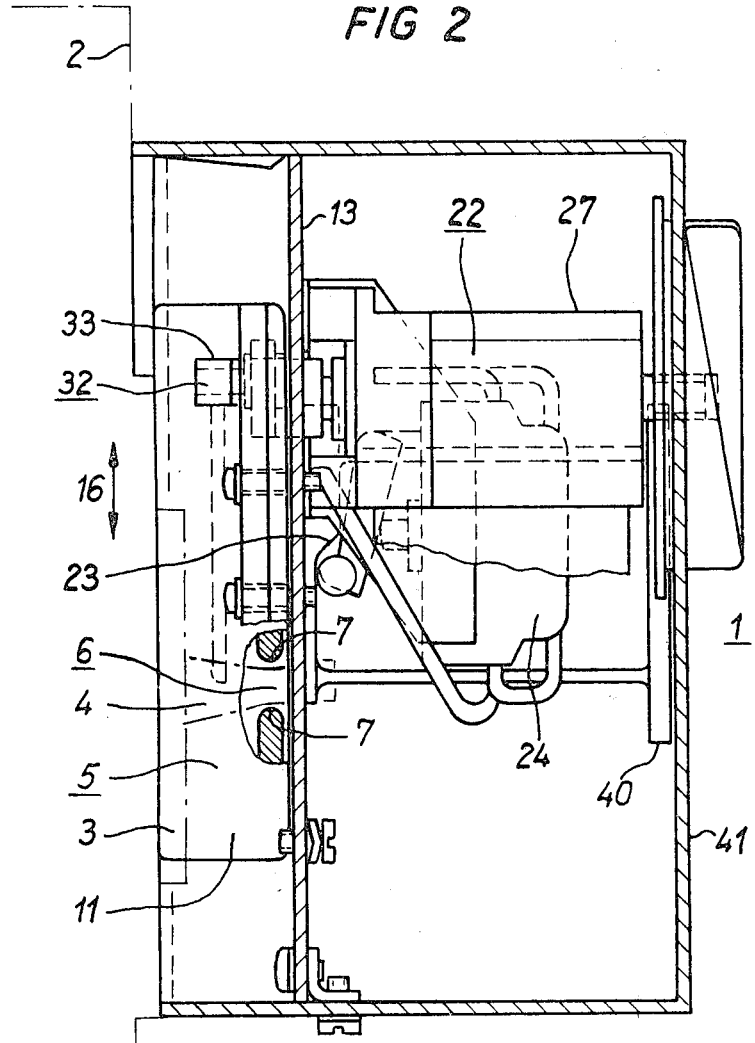
FIG. 2 is a side view of the power drive of FIG. 1.

Referring more particularly to the drawings, a power drive according to the invention, designated generally by 1 in FIGS. 1 and 2, is illustrated. The power drive 1 is associated with a compact protective low-voltage breaker 2, the outline of which is shown in part in FIG. 2 by dashed-dotted lines. From A central projection 3 of the protective breaker 2 protrudes an actuating handle 4, with which the protective breaker 2 can normally be switched on and off by hand. A drive slide 5 cooperates with the actuating handle 4 through a window-like opening 6. The opening 6 is defined by two curved surfaces 7, which are spaced to correspond essentially to the width of the actuating handle 4, and enlargements 10 provided on each side of the curved surfaces 7. The surface 7 as well as the enlargements 10 can be made of a plastic material, as can the drive slide 5. The enlargements 10 ensure that there are no corners or edges which could locally cause increased stress of the material of the actuating handle 4. The distance between the surfaces 7 is chosen so that there is little play between a respective surface and the actuating handle 4 in the end positions of the actuating handle, thereby preventing jamming. FIG. 2 shows an intermediate position of the handle 4 obtained when the protective breaker 2 is switched on or off.

For lateral guidance of the drive slide 5, side walls 11 and 12 are provided. The side walls of the drive slide extend over the projection 3 on the top or front side of the protective breaker 2 (FIG. 2). One surface of the drive slide 5, together with the drive slide side walls, slides on the top surface of the protective breaker 2, while the opposite surface of the drive slide is guided at a support plate 13 which is connected to the protective breaker 2 by, for example, means of screws at four fastening points.

When the power drive 1 and the protective breaker 2 are provided as an assembly, as shown in the assembled configuration of FIGS. 1 and 2, the above-described surfaces effectively guide the drive slide. However, when the power drive 1 is provided separate from the protective breaker 2 and is to be installed on the protective breaker, means are provided to prevent detachment of the drive slide 5 from the power drive. Such means can comprise an elongated hole or slot 15 disposed on one side of the drive slide 5. The slot 15 extends parallel to the operational direction of motion of the drive slide 5, as indicated by the double arrow 16, in a part laterally projecting from the side wall 11. A pin or screw 17 is fastened to the support plate and extends through the elongated hole. The pin or screw includes a head, washer or a securing ring which prevents the drive slide 5 from separating from the support plate.

On the opposite side of the drive slide 5, i.e., in the vicinity of the side wall 12, the drive slide 5 has two ribs 20, one of which is visible in FIG. 1. The ribs cooperate with stop surfaces 21 of a control slide 22 which has a cam surface 23 (FIG. 2) for a toggle switch 24. Due to the fact that the length of the ribs 20 is larger than the length of the stop surfaces 21 of the control slide 22, the drive slide and the control slide are not directly coupled, there being a certain amount of play between the two so that the control slide is operated as a drag slide.

Figure 3:
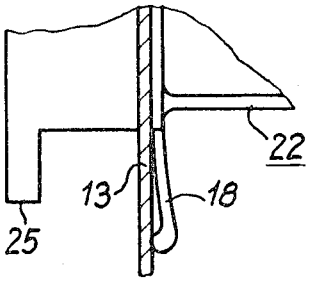
FIG. 3 is a detail of a portion of the control slide of the power drive of FIG. 1.

The control slide 22 is movably guided lengthwise in the direction of the double arrow 16 in a slot of the support plate 13, and includes arms 25 extending below the ribs 20 of the drive slide 5. A resilient extension 18 (FIG. 3) of the control slide 22 bears against its contact surface on the support plate 13 and thereby causes a frictional braking action of the control slide in order to prevent motion of the control slide without a drive being applied thereto. The arms 25 of the control slide supplement holding of the drive slide 5 by the above-described holding member 17. As a result, the drive slide is held at the support plate 13 with considerable play but in such a manner that it cannot come loose and can therefore be placed on the protective breaker 2 together with the other parts of the power drive. When the power drive 1 and the protective breaker 2 are connected to each other at the above-mentioned fastening points, guidance is transferred from the holding member 17 and the arm extensions 25 to the operating handle 4 and the curved surfaces 7, and the support plate 13 and the top side of the protective breaker 2.

The control slide 22 has an indicator 40 (FIG. 2) which fits closely under a cap 41 which covers the power drive 1 from the outside, and which is provided with markings to indicate the switch position. The control slide therefore fulfills several functions, controlling not only switching of motor 26 which is described more fully below, but forming at the same time a holder for the drive slide 5 and indicating the switch position.

The power drive 1 further comprises the motor 26 coupled to a gear box 27 which includes an output shaft 28 perpendicular to support plate 13 having a crank arm 29 and a crank pin 30. The crank pin 30 is engaged between the legs 31 of a leaf spring 32 bent in a U-shape. The leaf-spring 32 extends transversely to the direction of motion of the drive slide 5 and is supported at the drive slide in an opening 33 at one end thereof and in an opening 34 at the other end thereof. The opening 34 merges into a pocket-like recess 35 into which one leg 31 of the leaf-spring 32 having a bent-off end 36 snaps. A screw 37 passes between the legs 31 of the leaf-spring in the vicinity of the opening 34 and braces the legs against each other. By rotating the crank arm 29 in the same direction by 180°, the protective breaker can be switched alternatingly on and off. In the position shown in FIG. 1, the drive slide with the operating handle 4 is in a middle position corresponding to a rotation of the crank arm 29 by about 90° relative to is ends positions.

The U-shaped leaf-spring 32 inserted into the drive slide 5 brings about an elastic transmission of the driving force of the motor 26 via the gear box 27 and the crank pin 30 to the operating handle 4 of the protective breaker 2. Thereby, tolerances in the cooperation of the protective breaker 2 and the motor drive 1 are accommodated and overloading of the individual parts, particularly the operating handle 4, is prevented.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purpose of the disclosure without departing from the spirit and scope of the invention.

What is claimed is:

1. In a power drive for electric switchgear, particularly protective low-voltage breakers, including a support plate and a drive slide having a window-like opening into which an actuating member of the switchgear extends to couple the drive slide to the actuating member, the improvement comprising arrangement of the drive slide between the support plate and a surface of the switchgear beyond which the actuating member extends, the drive slide being in sliding engagement with said support plate and said surface and being guided therebetween.

2. The improvement according to claim 1, wherein surfaces of the window-like opening are defined by curved surfaces and comprise plastic material.

3. The improvement according to claim 2, wherein the drive slide comprises plastic material.

4. The improvement according to claim 1 or 3 wherein the drive slide includes side walls and the switchgear includes a projection extending between the side walls of the slide from the switchgear surface from which the actuating member extends.

5. The improvement according to claim 1, wherein the drive slide includes an elongated slot extending in the direction of motion of the drive slide and the power drive includes at least one holding member connected to the support plate and extending through the slot to prevent separation of the drive slide from the support plate.

6. The improvement acording to claim 1 and comprising a control slide for securing the drive slide to the support plate and for coupling driving power to the drive slide.

7. The improvement according to claim 6, wherein the control slide includes an arm and is guided on the support plate parallel to the direction of motion of the drive slide, the drive slide including on a side opposite to a side which includes the elongated hole at least one rib which is engageable by the arm of the control slide.

8. The improvement according to claim 7, wherein the control slide cooperates with the rib of the drive slide to maintain the drive slide secured to the support plate.

9. The improvement according to claim 6 or 8, wherein the control slide includes means for frictionally bearing against the support plate to provide drag for the control slide.

10. The improvement according to claim 6 or 8, wherein the control slide carries a control cam for a snap end switch, and includes markings for the "on" position and the "off" position of the switchgear.

11. The improvement according to claim 1 and comprising a motor for driving the drive slide and means for elastically coupling the motor to the drive slide.

12. The improvement according to claim 6 or 8 and comprising a motor for driving the drive slide and means for elastically coupling the motor to the drive slide.

13. The improvement according to claim 12 and comprising a crank arm coupled to the motor, the crank arm having a crank pin, wherein the drive slide has openings therein for receiving a leaf-spring which is arranged transversely to the direction of motion of the drive slide and cooperates with the crank pin for elastically coupling the motor to the control slide.

14. The improvement according to claim 13, wherein the drive slide includes at least one further surface which is in sliding engagement with another surface of the switchgear to further guide the drive slide.

15. The improvement according to claim 14 wherein said further surface is a side surface of said drive slide extending generally perpendicular to said support plate.

* * * * *